US005246555A

United States Patent [19]

Takayama

[11] Patent Number: 5,246,555

[45] Date of Patent: Sep. 21, 1993

[54] WORK BED FOR A GRINDING APPARATUS

[75] Inventor: Kazutoshi Takayama, Nakano, Japan

[73] Assignee: Nissei Plastics Industrial Co., Ltd., Japan

[21] Appl. No.: 752,627

[22] PCT Filed: Dec. 28, 1989

[86] PCT No.: PCT/JP89/01320

§ 371 Date: Aug. 27, 1991

§ 102(e) Date: Aug. 27, 1991

[87] PCT Pub. No.: WO91/09706

PCT Pub. Date: Jul. 11, 1991

[51] Int. Cl.[5] ..... B23H 5/06; B23H 5/08

[52] U.S. Cl. ..... 204/217; 204/297 R

[58] Field of Search ..... 204/217, 297 R, 129.46

[56] References Cited

U.S. PATENT DOCUMENTS 2,764,543 9/1956 Comstock 3d et al. ..... 204/217

3,272,732 9/1966 Faulkner ..... 204/297 R 4,641,007 2/1987 Lach ..... 204/217 X 4,956,056 9/1990 Zubatova et al. ..... 204/129.46 X 5,108,561 4/1992 Kuromatsu ..... 204/217 X

FOREIGN PATENT DOCUMENTS 62-10780 3/1987 Japan .

*Primary Examiner*—Donald R. Valentine

*Attorney, Agent, or Firm*—Ostrolenk, Faber, Gerb & Soffen

[57] ABSTRACT

This invention relates to a work bed for a grinding apparatus provided with a work table (9) which moves in a direction of X-axis and in a direction of Y-axis, comprising X-axis and Y-axis set to an upper surface of the work table (9), and a conductive dresser member (13) and a measuring reference member (14) provided on the upper surface of the work table (9) with operating surfaces thereof being parallel with the X-axis or Y-axis.

8 Claims, 4 Drawing Sheets

WORK BED FOR A GRINDING APPARATUS

FIELD OF THE ART

This invention relates to a work bed for a grinding apparatus capable of grinding or polishing metal parts.

BACKGROUND

Where a grinding wheel is rotated to grind or polish a workpiece, the grinding wheel becomes worn as a result of its functioning, or grinding filings enter between grains of the grindstone, as a consequence of which blinding or filling-up occurs, resulting in a lowering of grinding efficiency. Therefore, the grinding operation is discontinued every fixed time, and the surface is shaved by a grindstone tool called a dresser to project the grindstone grains on the surface.

This grindstone operation is generally called dressing. For the dressing of a grinding wheel for precise grinding, a diamond dresser is used. In such a case, it is necessary to pay sufficient attention to setting of a dressing with respect to the grinding wheel so that the surface of the grinding wheel is not excessively shaved, which requires skill.

Dressing by way of discharge is also well known. In either case, the diameter of the grinding wheel is decreased due to the dressing. It is therefore necessary to change the offset amount with respect to a work.

The change of the offset amount of the grinding wheel after dressing is carried out by artificially placing the grinding wheel into contact with the surface to be worked. Confirmation of the contact between the grinding wheel and the surface to be worked is made by listening to an insignificant contact noise at that time or looking at sparks generated by grinding. In view of the foregoing, grinding work accomplished by the grinding wheel requires time as compared with cutting work, drilling work, etc. The decrease in diameter of the grinding wheel due to the wear of the surface is insignificant. The diameter after dressing may be measured by mechanical or electric means. However, it has been difficult to automatically set a new grinding-wheel position on the basis of the measured value.

DISCLOSURE OF THE INVENTION

This invention solves the aforementioned problems with respect to the grinding work by way of the grinding wheel and has been conceived in order to automate grinding work and polishing work similar to the case of other metal work means. An object of this invention is to provide a work bed for a grinding apparatus capable of continuously performing grinding or polishing work, dressing of a grinding wheel and measurement of a diameter of a grinding wheel after dressing, and decision of a set position of a grinding wheel on the basis of the measured value, on one and the same work table.

A further object of this invention is to provide a work bed for a grinding apparatus capable of being applied to a composite working machine which has many work functions such as cutting work by way of a milling machine, drilling work by way of a drill, discharge work, grinding work by way of an electrolytic in process dressing grinding process, etc.

For achieving the aforesaid objects, this invention provides a grinding apparatus comprising means for moving a work table on a machine bed in a direction of X-axis and in a direction of Y-axis, an energizable spindle vertically movably provided upwardly of the work table, and a conductive grinding wheel mounted on the extreme end of the spindle, wherein a conductive dresser member and a measuring reference member are provided on the upper surface of the work table so that operating surfaces thereof are parallel with the X-axis or Y-axis of the work table.

The X-axis and the Y-axis of the work table are set by an X-axis reference member and a Y-axis reference member provided at right angles to each other on the upper surface of the work table, and the conductive dresser member and the measuring reference member are provided on the upper surface of the Y-axis reference member so that operating surfaces thereof are parallel with the X-axis or Y-axis.

The dresser member and the measuring reference member are formed of metal blocks having an electrical conductivity, or formed from a single metal block, as the case may be.

The aforesaid work is provided in contact with both the X-axis reference member and the Y-axis reference member. The work table forms a bottom portion of a liquid vessel, and grinding operation of work and dressing of the grinding wheel are carried out within working liquid in the liquid vessel.

Dressing of the grinding wheel can be carried out making use of discharge. Grinding operation, measuring and dressing of the grinding wheel, etc. are all started with an intersection between the X-axis and the Y-axis on the work table as a reference point. Movement of a grinding wheel is accomplished by movement of the work table by means of a moving mechanism.

Accordingly, in this invention, grinding operation and dressing operation, calculation of the diameter of a grinding wheel which changes with dressing, the change in offset amount based on the diameter, etc. can be carried out on one and the same work table as the continuous steps under NC control. From the foregoing, automation of grinding work including dressing of a grinding wheel which has been heretofore impossible is made possible.

Furthermore, in this invention, metal works such as cutting work, discharge work and electrolytic grinding work can be applied to a work bed of a composite working machine which has already been carried out employing NC control to rationalize a series of metal works including a grinding step. Especially, in manufacturing molds, there is an advantage that all works can be automatically carried out by a single machine.

This invention will be described in detail hereinafter by way of embodiments shown in the drawings.

BRIEF DESCRIPTION OF THE DRAWINGS

The drawings show one embodiment of a work bed for a grinding apparatus according to this invention.

BEST MODE FOR CARRYING OUT THE INVENTION

Figure 1:
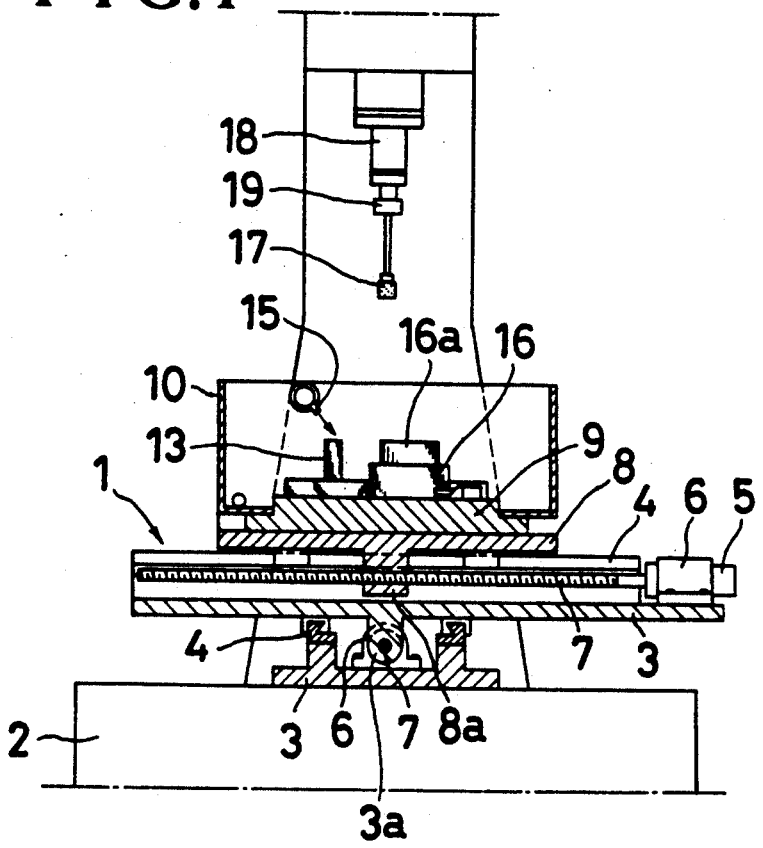
FIG. 1 is a schematic front view of essential parts of a grinding apparatus showing a work bed in longitudinal section.

In the figures, reference numeral 1 designates a moving mechanism installed on a machine bed 2, in which two sets of feed mechanisms each comprising a pair of guide rails 4 provided on a rectangular plate 3 and a bowl screw shaft between the guide rails rotated by a servomotor 6 provided with a position detector 5 are combined up and down at right angles to each other.

A base plate 8 and the plate 3 of an upper feed mechanism are movably fitted into the upper guide rail 4 of the moving mechanism 1 and the lower guide rail 4, respectively, and the bowl screw shaft 7 is screwed into screw receivers 3*a* and 8*a* projected on the lower surface thereof.

In such a moving mechanism 1, when the servomotor 6 of the lower feed mechanism is driven, the base plate 8 is moved along with the upper feed mechanism in a lateral direction (hereinafter referred to as an X-axis direction) in a horizontal plane of the machine bed 2, and the base plate 8 is moved by the upper feed mechanism also in a longitudinal direction (hereinafter referred to as a Y-axis direction).

A position of a work table 9 moved by the drive of each servomotor 6, substantially a postion of a grinding wheel 17 on the work table is detected by the position detector 5 provided on the servomotor 6, and the servomotor 6 is driven and controlled on the basis thereof.

The work table 9 has a rectangular shape and is secured onto the base plate 8. This work table 9 forms a bottom portion of a liquid vessel 10, and an X-axis reference member 11 and a Y-axis reference member 12 are incorporated at right angles on the plane.

A dresser member 13 and a measuring reference member 14 are aligned on a line on the upper surface of the Y-axis reference member 12 so that operating surfaces thereof are parallel with the Y-axis. These members are formed from a rectangular parallelopiped block formed of metal material having an excellent electrical conductivity, for example, copper, and DC current is applied to the dresser member 13. Upwardly of the dresser member 13, a nozzle 15 for discharge work liquid is provided obliquely and downwardly so that dressing can be carried out while causing an electrolytic work liquid to flow-out.

Reference numeral 16 designates a work which is square in plane shape and is provided in an upper central portion with a square core 16*a*, the side of which need be ground. This work 16 is secured onto the work table with the side thereof placed in contact with both the X-axis reference member 11 and the Y-axis reference member 12, and the work is moved along with the work table 9 in the X-axis direction or Y-axis direction or in the synthesized direction horizontally by the moving mechanism 1.

Reference numeral 17 designates a grinding wheel, which is formed from conductive grindstones such as a straight type cast iron fiber bond CBN grindstone, a cup type cast iron fiber bond CBN grindstone, etc., the grinding wheel 17 being mounted on a spindle 18 upwardly of the work table using a chuck 19.

The spindle 18 is connected to a drive shaft of a motor provided within an elevator device, though not shown, and moves up and down along with the grinding wheel 17 chucked to the lower end. A plus DC current can be applied to the spindle 18 during dressing.

Figure 2:
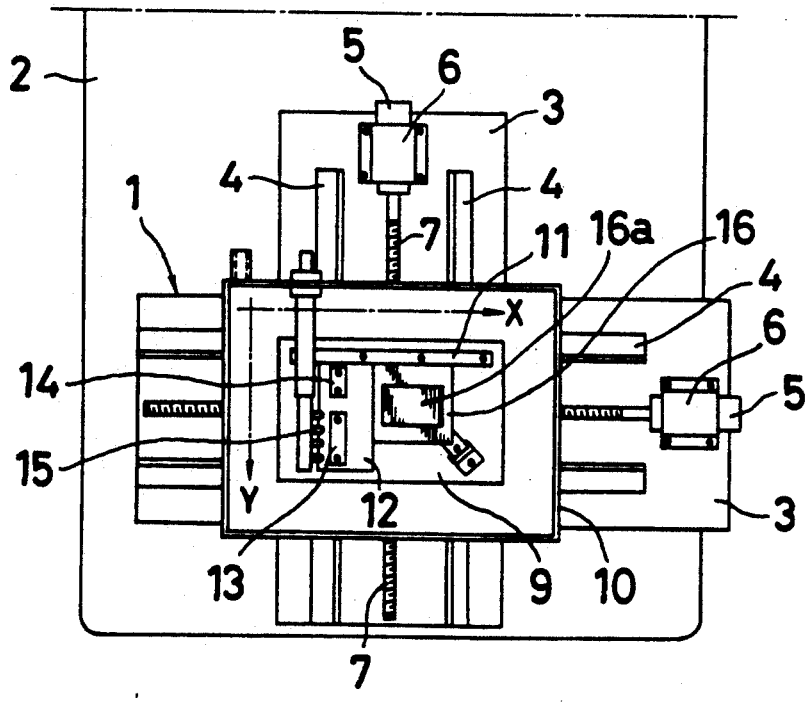
FIG. 2 is a plan view of the work bed.

Such a grinding apparatus is provided with an NC control unit. Data prepared in advance are inputted into the NC control unit so that the center position of the grinding wheel 17 on the work table, the position of various members installed on the work table and the work 16 or the position of the operating surface or grinding surface can be read with an intersection (see FIG. 2) between the X-axis and the Y-axis at a suitable position on the work table as an operating reference point. The grinding work caused by the rotation of the grinding wheel, dressing, measurement of diameter, etc. are automatically and in order carried out on the basis of said data or under collation.

It is to be noted that the offset and movement of position in this apparatus are all carried out by moving the work table 9 through the rotation of the screw shafts 7 rotated by the drive of the servomotors 6 at upper and lower positions. The grinding wheel 17 is not moved but always remains positioned at a point. However, an expression of "movement of a grinding wheel" is also used for the sake of explanation.

Figure 3:
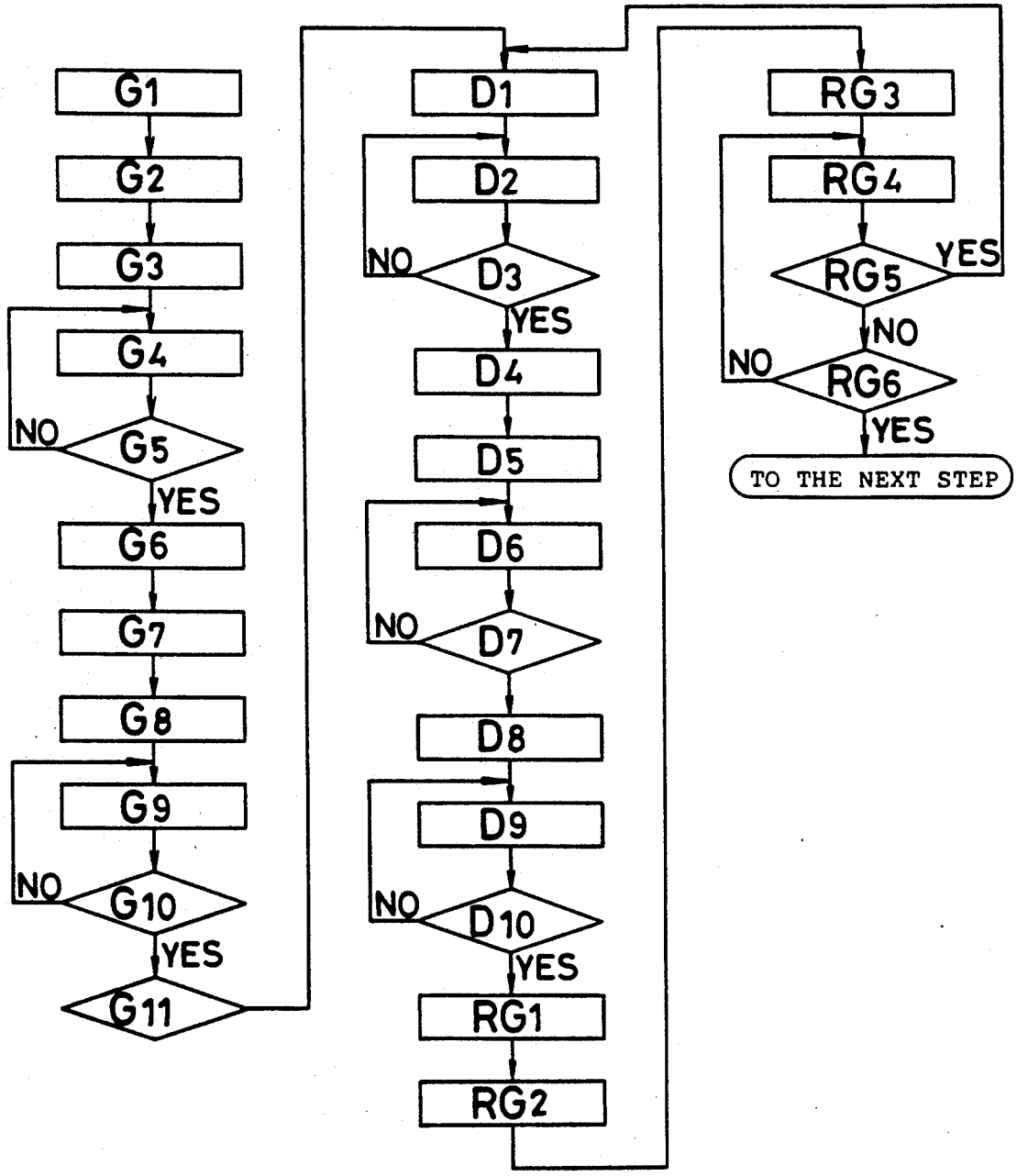
FIG. 3 is a flow chart for grinding steps and dressing steps.
Figure 4:
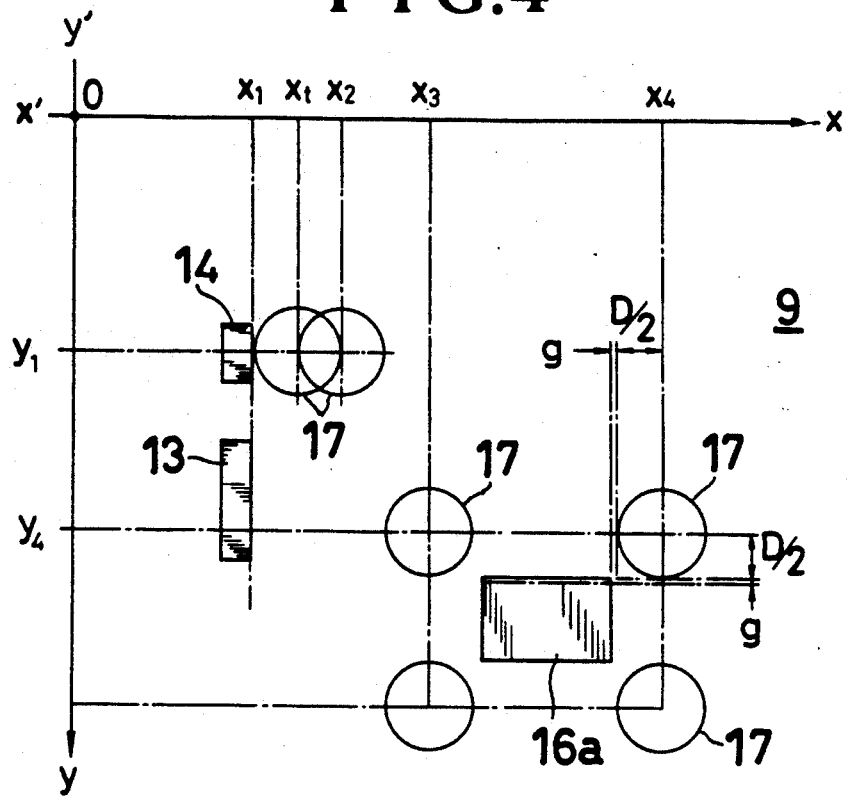
FIG. 4 is an explanatory view of a position of a grinding wheel in the grinding step.
Figure 5:
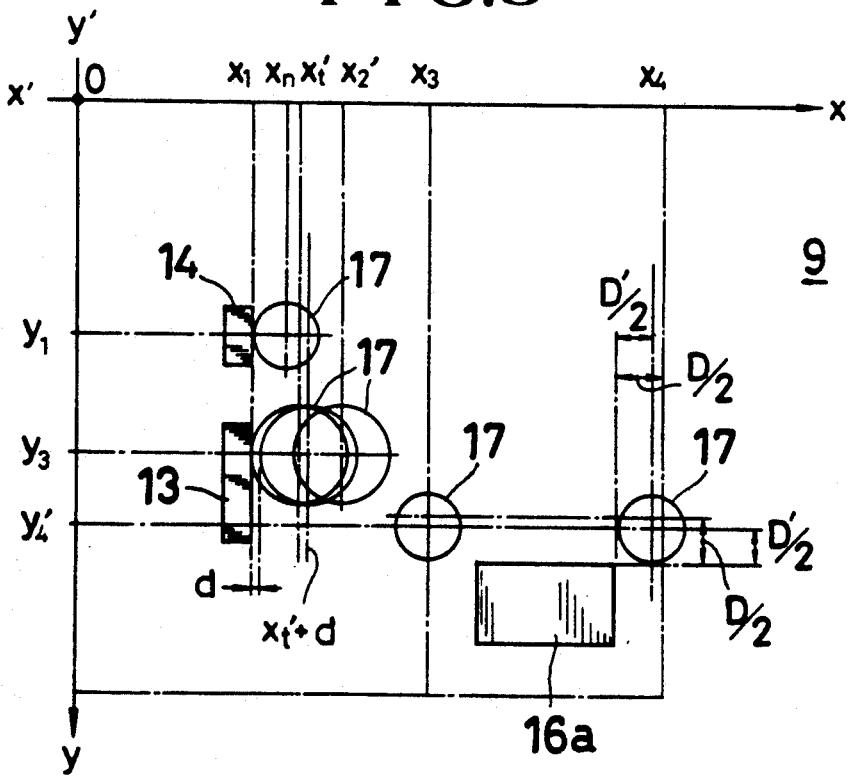
FIG. 5 is an explanatory view of a position of a grinding wheel in the dressing step.

FIG. 3 is a flow chart for grinding steps and dressing steps capable of being carried out using the work bed according to this invention, and FIG. 4 and FIG. 5 show x and y positions of the grinding wheel 17 shown in the flow chart.

The aforesaid flow chart will be described hereinafter with reference to these drawings.

Grinding step (see FIG. 4)

G1 "Measurement of dimension of work": The measurement is carried out after the input of work shape.

G2 "Setting": After the input of measured value, the grinding wheel 17 is moved to the operating reference point 0 for setting.

G3 "Movement of grinding stone to a measuring reference position": The grinding wheel 17 is moved from the operating reference point 0 to $x_2$, $y_l$.

G4 "Placing in contact with measuring reference member": The work table 9 is moved in a direction of x, and the surface of the grinding wheel 17 is placed in contact with the measuring reference member 14. A low current is made to flow in advance between the measuring reference member 14 and the grinding wheel 17.

G5 "Confirmation of contact": Confirmation of contact is effected by the presence or absence of energization. If the contact is not confirmed, the contact is considered to be insufficient, and the work table 9 is continued to be moved in a direction of x.

G6 "Detection of center position of grinding wheel": $x_l$, $y_1$ positions are read.

G7 "Calculation of diameter D of grinding wheel": A measuring surface position $x_1$ of the reference member 14 is subtracted from the measuring position $x_l$, result of which is doubled $(x_l - x_1) \times 2 = D$.

G8 "Operation for offset": An offset amount (D/2) of the grinding wheel 17 with respect to the grinding surface of the core 16*a* is electrically calculated from the calculated diameter. The work table 9 is moved in both directions of x' and y', the spindle 18 is moved down, and the grinding wheel 17 is offset to $x_3$ and $y_4$.

G9 "Grinding": The liquid vessel is filled with a work liquid formed of mineral oil whose principal component comprises a paraffin group hydrocarbon. The grinding wheel 17 is rotated at high speed (ϕ8: 10,000 rpm) together with the spindle 18 while moving the work table 9 in a direction of x', and grinding is carried out within the work liquid. This grinding is carried out in such a manner that the grinding wheel 17 is caused to move the work table 9 to $x_4$, and a cut amount g is set in advance.

G10 "Over of set time": When a predetermined grinding time is over, response is carried out if dressing is necessary.

G11 "Momentary termination of grinding": When dressing is judged to be necessary, grinding is stopped.

Dressing steps (see FIG. 5)

D1 "Movement to dressing reference position": The work table 9 is moved in directions of x and y to place the grinding wheel 17 at $x_2$ and $y_3$.

D2 "Placing in contact with dresser member": The work table 9 is moved in a direction of x, and the grinding wheel 17 is placed in contact with the dresser member 13 through which a low current flows.

D3 "Confirmation of contact": Contact between the grinding wheel 17 and the dresser member 13 is electrically effected by confirmation of energization.

D4 "Detection of center position of grinding wheel": Positions of $x_t'$ and $y_3'$ are read.

D5 "Movement to dressing start position": Since in the dressing by way of electrolyte, a discharge gap is required, the grinding wheel 17 is moved to a position $(x_t'+\alpha, y_3)$ to which is added a preset discharge gap $\alpha$.

D6 "Start of dressing": A current between the spindle 16 and the dressing member 13 is made to be a high current to rotate the grinding wheel at high speed, the grinding wheel 17 is moved along the dresser member 13 by the movement of the work table 9 in direction of y', and dressing by way of discharge is carried out.

D7 "Completion of dressing": After a lapse of fixed time, the spindle 18 is stopped and a current is cutoff.

D8 "Movement of grindestone to measuring reference position": The grinding wheel 17 is moved to reference points $x_2$ and $y_1$.

D9 "Placing in contact with measuring reference member": The work table 9 is moved in a direction of x, and the surface of the grinding wheel 17 is placed in contact with the measuring reference member 14. A low current is made to flow in advance into the measuring reference member 14.

D10 "Confirmation of contact": Confirmation of contact is made by the presence or absence of energization. If energization is not confirmed, the contact is insufficient. The work table 9 is continued to be moved in a direction of x.

Re-grinding steps

RG 1 "Detection of center position of grinding wheel": Positions of $x_n$ and $y_1$ are read.

RG 2 "Calculation of diameter D of grinding wheel": A measuring surface position $x_1$ of the measuring reference member 14 is subtracted from the measuring position $x_t$, result of which is doubled $(x_t-x_1)\times 2=D'$.

RG 3 "Change of offset amount": Since the diameter of the grinding wheel has been decreased due to dressing, the offset amount is changed from diameter D/2 to diameter D/2, and the grinding wheel 17 is moved to $x_3$ and $y_4'$.

RG 4 "Restart of grinding": Grinding starts.

RG 5 "Over of set time": Response is effected if dressing is necessary. If dressing is necessary, the step returns to the dressing step Dl.

RG 6 "Termination of grinding": The grinding wheel 17 is moved upward together with the spindle 18 and returns to its original position. Then, the apparatus is ready for the next grinding step.

Figure 6:
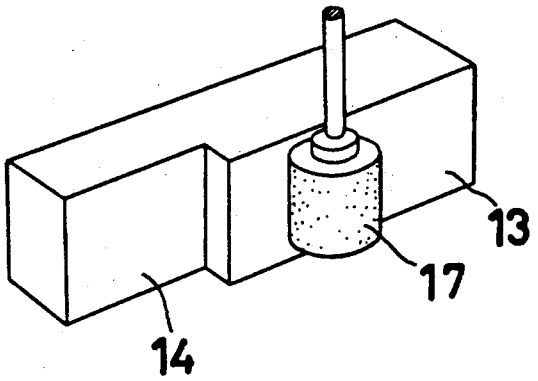
FIG. 6 is a perspective view of another embodiment of a dresser and a reference block.

While in the above-described embodiment, the dresser member 13 and the reference member 14 have been arranged on a line for dressing, it is to be noted that both the members may be arranged in the form of T, and a single block may be used in common. In such a case, if a shoulder portion is provided on the contact surface, as shown in FIG. 6, so that the dressing surface 13*a* is formed externally of the reference surface 14*a*, dressing of the grinding wheel 17 by discharge is carried out without being affected by the reference surface.

Moreover the work bed according to this invention can be applied to a composite working machine in which various metal workings can be carried out by the movement of the work table 9.

Figure 7:
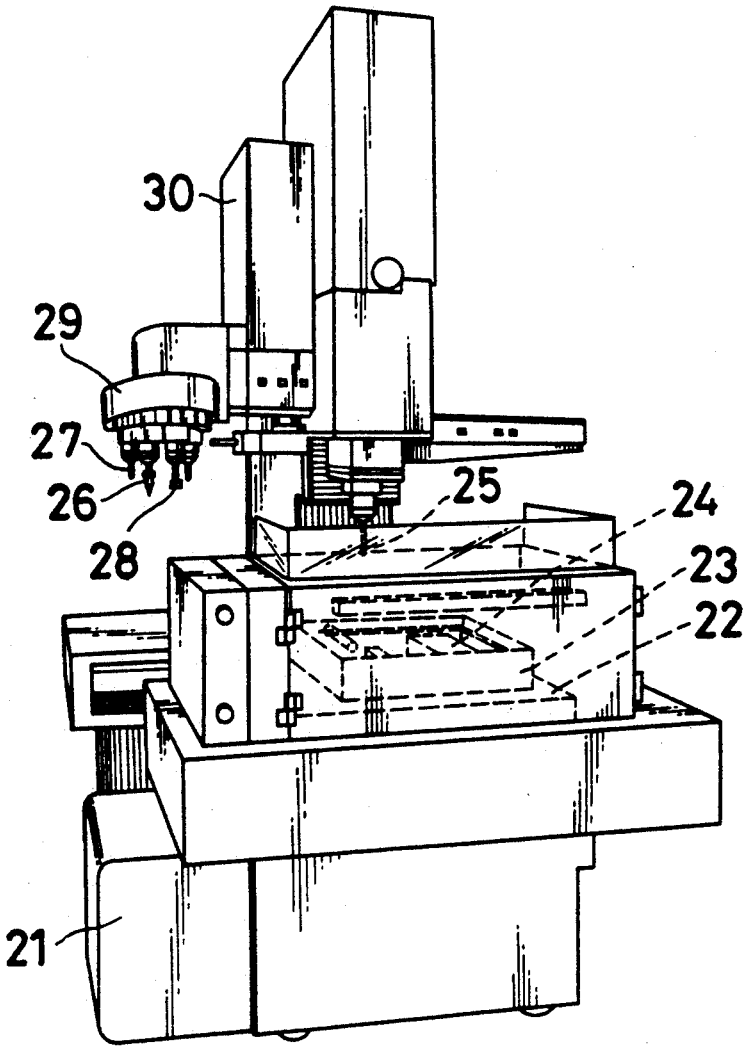
FIG. 7 is a perspective view of a composite working machine to which this invention can be applied.

FIG. 7 shows a composite working machine previously developed by the present inventor (For details, refer to International Application No. W089/03745), wherein a machine bed 21 is provided thereon with a work table 22 which moves in directions of X-axis and Y-axis, and a work 24 is put into a liquid vessel 23 on the work table so that cutting work, discharge work, electrolytic grinding work, etc. can be carried out by exchange of work tools.

Accordingly, if the work bed of this invention is applied to the work table 22, the composite working machine can also perform easily grinding on the basis of the aforementioned flow chart.

In the figure, reference numeral 25 designates a drill; 26, a measuring probe; 27, a discharge electrode; 28, a grindstone for grinding; 28 and 29, a magazine for receiving a working tool; and 30, an automatic exchanger.

INDUSTRIAL APPLICABILITY

As mentioned above, in the work bed according to this invention, grinding of a work attached to the work table and movement of position of a grinding wheel can be performed by movement of the work table in a direction of X-axis and Y-axis, and change of an offset amount caused by dressing and measured values of the grinding wheel after dressing can be automatically performed with the X-axis and Y axis as a reference. Therefore, the grinding wheel is offset without manual operation. Automation of grinding work including dressing which has been heretofore difficult becomes possible. In addition, in the composite working machine, the operating efficiency is materially enhanced due to the automation of discharge grinding. Its effect is extremely great in terms of industry. It is also economical. Thus, the apparatus is widely used by those skilled in the art.

I claim:

1. In a grinding apparatus comprising means for moving a work table on a machine bed in a direction of X-axis and in a direction of Y-axis, an energizable spindle vertically movably provided upwardly of the work table, and a conductive grinding wheel mounted on the extreme end of the spindle, a work bed for a grinding apparatus characterized in that a conductive dresser member and a measuring reference member are provided on the upper surface of the work table so that operating surfaces thereof are parallel with the X-axis or Y-axis of the work table.

2. A work bed for a grinding apparatus according to claim 1, wherein the X-axis and the Y-axis of the work table are set by an X-axis reference member and a Y-axis reference member provided at right angles to each other on the upper surface of the work table, and the conductive dresser member and the measuring reference member are provided on the upper surface of the Y-axis reference member so that operating surfaces thereof are parallel with the X-axis or Y-axis.

3. A work bed for a grinding apparatus according to claim 2, wherein the dressor member and the measuring reference member are formed of metal blocks having an electrical conductivity.

4. A work bed for a, grinding apparatus according to claim 2, wherein, the dresser member and the measuring reference member are formed of a single metal block having an electrical conductivity.

5. A work bed for a grinding apparatus according to claim 2, wherein the work table forms a bottom portion of a liquid vessel which renders possible operations of discharge grinding and dressing in the work liquid.

6. A work bed for a grinding apparatus according to claim 1, wherein the dresser member and the measuring reference member are formed of metal blocks having an electrical conductivity.

7. A work bed for a grinding apparatus according to claim 1, wherein the dresser member and the measuring reference member are formed of a single metal block having an electrical conductivity.

8. A work bed for a grinding apparatus according to claim 1, wherein the work table forms a bottom portion of a liquid vessel which renders possible operations of discharge grinding and dressing in the work liquid.

* * * * *